US011085646B2

(12) United States Patent
Sadasivuni

(10) Patent No.: US 11,085,646 B2
(45) Date of Patent: Aug. 10, 2021

(54) TECHNIQUE FOR CONTROLLING OPERATING POINT OF A COMBUSTION SYSTEM BY USING PILOT-AIR

(71) Applicant: Siemens Aktiengesellschaft, Munich (DE)

(72) Inventor: Suresh Sadasivuni, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 271 days.

(21) Appl. No.: 16/333,421

(22) PCT Filed: Sep. 21, 2017

(86) PCT No.: PCT/EP2017/073937
§ 371 (c)(1),
(2) Date: Mar. 14, 2019

(87) PCT Pub. No.: WO2018/060054
PCT Pub. Date: Apr. 5, 2018

(65) Prior Publication Data

US 2019/0249878 A1 Aug. 15, 2019

(30) Foreign Application Priority Data

Sep. 29, 2016 (EP) ..... 16191305

(51) Int. Cl.
*F23R 3/34* (2006.01)
*F23N 5/24* (2006.01)

(52) U.S. Cl.
CPC ..... *F23R 3/343* (2013.01); *F23N 5/242* (2013.01)

(58) Field of Classification Search
CPC .... F02C 7/228; F02C 9/26; F02C 9/28; F02C 9/34; F02C 9/44; F23R 3/34; F23R 3/343; F23R 3/346; F23R 2900/00013
See application file for complete search history.

(56) References Cited

U.S. PATENT DOCUMENTS 4,337,616 A 7/1982 Downing
5,207,064 A * 5/1993 Ciokajlo ..... F23R 3/16 60/737

(Continued)

FOREIGN PATENT DOCUMENTS

CN 102549342 A 7/2012
CN 103154616 A 6/2013

(Continued)

OTHER PUBLICATIONS

Goyal et al, NASA Advanced Low Emissions Combustor Program, ASME Paper #83-JPGC-GT-10, p. 3 (Year: 1983).*

(Continued)

*Primary Examiner* — Arun Goyal

(57) ABSTRACT

A method for controlling pilot-fuel/pilot-air ratio provided to a burner of a combustion system for altering its operating point. First, a value of a first parameter e.g. temperature, is checked, and if the value equals or exceeds a predetermined maximum limit of the first parameter that places the operating point in a first undesired region of operation, then a pilot-fuel/pilot-air ratio is altered such that the value of first parameter is moved to below the first parameter's predetermined maximum limit. Similarly, a value of a second parameter e.g., pressure, is checked, and if the value equals or exceeds a predetermined maximum limit of the second parameter that places the operating point in a second undesired region of operation, then again the pilot-fuel/pilot-air ratio is altered such that the value of second parameter is moved to below the second parameter's predetermined maximum limit. A combustion system operates according to the method.

11 Claims, 8 Drawing Sheets

(56) References Cited

U.S. PATENT DOCUMENTS

| | | | | |
|---|---|---|---|---|
| 6,332,313 | B1 * | 12/2001 | Willis | F23R 3/14 60/776 |
| 7,302,334 | B2 | 11/2007 | Hook et al. | |
| 7,593,803 | B2 | 9/2009 | Healy et al. | |
| 8,499,564 | B2 | 8/2013 | Martin et al. | |
| 2009/0217672 | A1 | 9/2009 | Bulat et al. | |
| 2014/0277790 | A1 | 9/2014 | Gauthier et al. | |

FOREIGN PATENT DOCUMENTS

| | | | |
|---|---|---|---|
| EP | 1533573 | A1 | 5/2005 |
| EP | 2442031 | A1 | 4/2012 |
| GB | 2434437 | A | 7/2007 |
| JP | 2005155622 | A | 6/2005 |
| JP | 2016023820 | A | 2/2016 |
| JP | 2016038108 | A | 3/2016 |
| RU | 2411385 | C2 | 12/2006 |
| RU | 2595292 | C2 | 9/2011 |

OTHER PUBLICATIONS

International search report and written opinion dated Dec. 1, 2017 for corresponding PCT/EP2017/073937.

* cited by examiner

TECHNIQUE FOR CONTROLLING OPERATING POINT OF A COMBUSTION SYSTEM BY USING PILOT-AIR

CROSS REFERENCE TO RELATED APPLICATIONS

This application is the US National Stage of International Application No. PCT/EP2017/073937 filed Sep. 21, 2017, and claims the benefit thereof. The International Application claims the benefit of European Application No. EP16191305 filed Sep. 29, 2016. All of the applications are incorporated by reference herein in their entirety.

FIELD OF INVENTION

The present invention relates generally to techniques for controlling operating point of combustion systems, and more particularly to techniques for controlling operating point of a combustion system by using pilot-air.

BACKGROUND OF INVENTION

In a gas turbine engine it is an aim to identify an optimum fuel split ratio between a pilot-fuel and a main-fuel which are injected into a combustion chamber, so that the best gas turbine engine operation may be achieved. The split ratio between the pilot-fuel and the main-fuel is generally represented by a default split curve that shows a ratio of pilot-fuel to total fuel (i.e. main-fuel and the pilot-fuel) recommended for different load levels or firing temperatures. In particular, high metal temperatures, such as high burner tip/face temperatures, and high dynamics in the combustion chamber are to be avoided, whilst increasing engine reliability with the lowest pollutant production, such as NOx, is desired. For example, a low $NO_x$ mix emissions may be achieved based on a use of lean main-fuel and air mixture with a huge experience of a known combustion system.

However, in practice the operating point of the combustion systems do not exactly adhere to default split map and tend to move into undesired regions of operation, because of variety of reasons that cannot be predicted accurately during generation of the default split map. Some of the reasons are type of fuel used which differs substantially from one type to another and also between within same type owing to differing percentages of constituents, varying ambient conditions, unintended load fluctuations, and so on and so forth. To solve this problem, several techniques for real time monitoring and control of operating point have been devised that allow changing or adjusting, with respect to a default split suggested by the default split curve, of the pilot-fuel and main-fuel ratio for navigating the operating point through progressively increasing load and avoiding the undesired regions of operation.

WO 2007/082608 discloses a combustion apparatus including an incoming fuel supply line, which supplies fuel in a plurality of fuel-supply lines to one or more burners. A burner comprises a combustion volume. A temperature sensor is located in the apparatus so as to yield temperature information relating to a component part of the apparatus, which is to be prevented from overheating. The apparatus also includes a control arrangement, which detects the temperature-sensor output and, depending on that output, varies the fuel supplies to one or more of the burners in such a way as to maintain the temperature of the component part below a maximum value, while keeping the fuel in the incoming fuel supply line substantially constant. The control unit also strives to adjust the operating conditions of the apparatus so that pressure oscillations are kept below a maximum value.

EP 2442031 A1 discloses a combustion device control unit and a combustion device, e.g. a gas turbine, which determine on the basis of at least one operating parameter whether the combustion device is in a predefined operating stage. In response hereto, there is generated a control signal configured for setting a ratio of at least two different input fuel flows to a predetermined value for a predetermined time in case the combustion device is in the predefined operating stage.

WO 2011/042037 A1 discloses a combustion apparatus with a control arrangement arranged to vary the fuel supplies to one or more burners based on a temperature information and on a pressure information and on a further information. The further information is indicative for a progress over time for a signal for a time span defined by a time information, such as to maintain the temperature of a desired part to be protected below a predetermined maximum temperature limit and such as to keep the pressure variations within the combustion volume below a predetermined maximum pressure variation limit, while keeping the overall fuel supply in the fuel supply line to the apparatus substantially constant.

WO 2015/071079 A1 discloses an intelligent control method with predictive emissions monitoring ability. The disclosure presents a combustor system, for a gas turbine engine, having a combustion chamber into which a pilot-fuel and a main-fuel are injectable and flammable, wherein an exhaust gas generated by the burned pilot-fuel and the burned main-fuel is exhaustible out of the combustion chamber. A control unit is coupled to a fuel control unit for adjusting the pilot-fuel ratio. The control unit is adapted for determining a predicted pollutant concentration of the exhaust gas on the basis of a temperature signal, a fuel signal, a mass flow signal and a fuel split ratio.

All the aforementioned techniques navigate the operating point of the combustion system or the combustion system by altering the ratio of the pilot-fuel and the main-fuel for different load levels. However, these alternations results in making lot of fluctuations in the pilot-fuel supply, in addition to fluctuations incorporated in the default split curve, and thus are disadvantageous for operation of the combustion system and to the gas turbine engine having the combustion system. Furthermore, the for implementing the aforementioned techniques, since the pilot-fuel is needed to be increased at some instances, the chances of higher temperatures, due to richness of the pilot-fuel, are always present and result in higher emissions.

SUMMARY OF INVENTION

Thus, an object of the present disclosure is to provide a technique that accomplishes the beneficial effects of controlling or navigating the operating point of a combustion assembly or system without solely depending on alterations of pilot-fuel amounts with respect to the main-fuel amounts. It is also the object of the present disclosure to provide a technique that allows controlling or navigating the operating point of the combustion system without altering the pilot-fuel/main-fuel ratio in addition to techniques, for example aforementioned techniques, that control or navigate the operating point of the combustion system by altering the pilot-fuel/main-fuel ratio. As a result the technique of the present disclosure is able to be used independently of or complementarily with the aforementioned techniques, for example to further tune or fine tune or further control the operating point.

The above object is achieved by a method for controlling pilot-fuel/pilot-air ratio provided to a burner of a combustion system for altering an operating point of the combustion system, a computer-readable storage media, a computer program, a combustion system, and a gas turbine engine, of the present technique. Advantageous embodiments of the present technique are provided in dependent claims.

The present technique makes use of a novel concept of using pilot-air to control combustion characteristics or to tune combustion characteristics. The operating point of a combustion system, also referred to as a combustion assembly, or a combustor system or assembly, or simply as a combustor or a burner system, is regulated by controlled introduction of the pilot-air, either premixed with the pilot-fuel or partially pre-mixed with the pilot-fuel or injected through a burner face from one or more separate injection holes immediately next to pilot-fuel injection holes. In a conventional combustor 15, as shown in FIG. 2, for gas turbine engines air is supplied through a swirler 29 and primarily mixed with the main-fuel to form the premix combustible reactants having the main-fuel and air. In conventionally known techniques of controlling operating point of combustors 15 generally no air is supplied as pilot-air and therefore no pilot-air is used.

The term 'pilot-air' as used in the present disclosure means air that is introduced along with the pilot-fuel, and may not include air introduced through swirler 29 (as shown in FIG. 2) or air introduced through other air inlets associated with a main burner or combustion chamber. Furthermore, the term 'pilot-air' includes, but not limited to, air introduced through a burner face of the combustion system or burner assembly in association with which the present technique is implemented, for example, 'pilot-air' is the air introduced through a burner face that has one or more pilot-fuel injection holes.

For example the 'pilot-air' is air introduced through the burner face that has one or more pilot-fuel injection holes (through which pilot-fuel is introduced) and one or more novel other holes, referred to as pilot-air injection holes, through which air, i.e. pilot-air, is introduced and wherein the pilot-fuel injection holes and the pilot-air injection holes are present on the same surface of the burner face. Yet another example of the 'pilot-air' is the air that is premixed with pilot-fuel, and then the mix of pilot-fuel and the pilot-air, i.e. the premixed pilot-fuel and pilot-air is introduced through one or more openings into the combustion volume.

The present technique uses at least two parameters, namely a first parameter and a second parameter. Generally, these parameters are factors that define or set the conditions of operation of the combustion system. The two parameters are those factors, for example a temperature inside the combustion chamber of the combustion system or amplitude of pressure in the combustion volume, that independently or in combination tend to move the operating point of the combustion system toward undesired regions of operation of the gas turbine engine having the combustion system in general and of the combustion system of the gas turbine engine in particular. The operating point is a specific point within the operation characteristic or operation of the combustion system and of the combustion seated in the combustion system. This point is engaged because of the properties of the combustion system and other components of the gas turbine engine, such as mass flow, firing temperatures, and also on influences originating from outside of the gas turbine engine for example a quality of fuel used, ambient temperature, etc. The undesired region(s) of operation are those conditions in which it is undesirable to operate i.e. to combust the fuel or operate the combustion system. The two undesired regions may be, but not limited to, undesired regions that have a push-pull effect i.e. operating point whilst moving away from one of the undesired region moves toward the other undesired region, and vice versa. Furthermore, the undesired regions are at least partially non-overlapping and thus allowing the operating point to move into desired region(s) of operation when moving out of one undesired region and towards the other undesired region.

A first example of undesired region may be, but not limited to, high burner tip temperatures as combustion of the fuel in high tip temperatures makes the operation undesirable because it makes the level of emissions (such as NOx, CO, etc.) higher in exhaust coming out of the combustion volume and this is undesirable. Furthermore, high temperatures or overheating of one or more parts of the combustion system, for the present example the burner tip or burner surface, reduces life and adversely impacts structural integrity of the part. Another example of undesired region may be, but not limited to, high dynamics in the combustor volume or combustion chamber of the combustion system as working the combustion system in high dynamics condition also makes the operation undesirable because it also reduces life and adversely impacts structural integrity of different parts associated with the combustion volume. Furthermore, high dynamics increases chances of flameout.

The first parameter may be, for example, one of a temperature of a part a combustion system and a pressure at a location of the combustion volume of a combustion system, and the second parameter may be the other of a temperature of a part a combustion system and a pressure at a location of the combustion volume of the combustion system.

When the first parameter is the temperature of the part of the combustion system, hereinafter also referred to as the part, then the 'predetermined maximum limit of the first parameter' would then mean the 'predetermined maximum limit of the temperature' of the part i.e. a value representing a maximum temperature of the part of the combustion system which is acceptable for operation of the combustion system at a given load level and/or operational condition of the combustion system. Any temperature value for the part or of the part that is higher than or more than the 'predetermined maximum limit of the first parameter' i.e. the 'predetermined maximum limit of the temperature' would be undesirable (due to causation of thermal damage to the part and/or high emissions in the exhaust from the combustion volume) and therefore unacceptable for operation of the combustion system. Furthermore, when the second parameter is the pressure at the location of the combustion volume of the combustion system, hereinafter also referred to as the location, the 'predetermined maximum limit of the second parameter' would then mean the 'predetermined maximum limit of the pressure' at the location i.e. a value representing maximum pressure at the location which is acceptable for operation of the combustion system at a given load level and/or operational condition of the combustion system. Any pressure value for the location or at the location that is higher than or more than the 'predetermined maximum limit of the second parameter' i.e. the 'predetermined maximum limit of the pressure' would be undesirable (due to causation of high dynamics or flameout) and therefore unacceptable for operation of the combustor.

Alternatively, when the second parameter is the temperature of the part, then the 'predetermined maximum limit of the second parameter' would then mean the 'predetermined maximum limit of the temperature' of the part i.e. a maximum temperature of the part of the combustion system which is acceptable for operation of the combustion system at a given load level and/or operational condition of the combustion system. Any temperature value for the part or of the part that is higher than or more than the 'predetermined maximum limit of the second parameter' i.e. the 'predetermined maximum limit of the temperature' would be undesirable (due to causation of thermal damage to the part and/or high emissions in the exhaust from the combustion volume) and therefore unacceptable for operation of the combustion system. Furthermore, when the first parameter is a pressure at the location, the 'predetermined maximum limit of the first parameter' would then mean the 'predetermined maximum limit of the pressure' at the location i.e. a maximum pressure at the location which is acceptable for operation of the combustion system at a given load level and/or operational condition of the combustion system. Any pressure value for the location or at the location that is higher than or more than the 'predetermined maximum limit of the first parameter' i.e. the 'predetermined maximum limit of the pressure' would be undesirable (due to causation of high dynamics or flameout) and therefore unacceptable for operation of the combustion system.

The 'predetermined maximum limit of the temperature' is predetermined or pre-known, i.e. determined or calculated or known before implementing the present technique for example before performing the method of the present technique or before operating the combustion system of the present technique, and depends on a variety of factors, such as a type of the part, a composition of material of the part, a function of the part, a position of the part with respect to other components of the combustion system, a make or design of the combustion system, a stage of operation of the combustion system, a maximum limit of the temperature known for similar parts in similar or differing combustor assemblies, a combination of one or more of the preceding factors, and so on and so forth.

The 'predetermined maximum limit of the pressure' is predetermined or pre-known, i.e. determined or calculated or known before implementing the present technique for example before performing the method of the present technique or before operating the combustion system of the present technique, and depends on a variety of factors, such as a position of the location with respect to the combustor volume, a make or design of the combustor chamber housing the combustor volume, a stage of operation of the combustion system, a maximum limit of the pressure known for similar locations in similar or differing combustor assemblies, a combination of one or more of the preceding factors, and so on and so forth.

The 'predetermined maximum limit of the temperature' is predetermined or pre-known from a designing of the part in particular and the combustion system in general, and may be pre-determined through testing of the part in particular and the combustion system in general, which may be performed physically or in simulations. Similarly, the 'predetermined maximum limit of the pressure' is predetermined or pre-known from a designing of the combustion chamber in particular and the combustion system in general, and may be pre-determined through testing of the combustion chamber in particular and the combustion system in general, which may be performed physically or in simulations. The 'predetermined maximum limit of the temperature' and the 'predetermined maximum limit of the pressure' may be provided with or determinable from specifications, documentation, or databases associated or supplied with the combustion system, for example the 'predetermined maximum limit of the temperature' and the 'predetermined maximum limit of the pressure' may be determinable from a split map (pilot-fuel to total fuel ratio corresponding to different firing temperatures) for the combustion system.

Furthermore in the present technique, the term 'value' of the first or the second parameter means an indication or signal that denotes or represents an algebraic term such as a magnitude, quantity, or number of the parameter, for example a numerical amount representing the magnitude of the parameter. A value for a parameter is said to be 'equal' to a 'predetermined maximum limit' of said parameter when the value is comparably same in magnitude as the predetermined maximum limit, for example if the predetermined maximum limit for temperature is 1500 K, then a value of temperature same as 1500 K is said to be equal to the predetermined maximum limit for temperature. Similarly, a value for a parameter is said to 'exceed' a 'predetermined maximum limit' of said parameter when the value is comparably higher or larger in magnitude as the predetermined maximum limit, for example if the predetermined maximum limit for temperature is 1500 K, then 1600 K i.e. the value of temperature is said to exceed the predetermined maximum limit for temperature.

The first parameter, and its value in a given condition may be sensed by using a suitable sensor for sensing the first parameter, for example when the first or the second parameter is temperature of the part, the value of the parameter will be a temperature reading provided by a temperature sensor, for example a thermocouple providing temperature reading of the burner head or the burner surface, when the burner head or the burner surface is the part.

The second parameter, and its value in a given condition may be sensed by using a suitable sensor for sensing the first parameter, for example when the first or the second parameter is pressure at the location, the value of the parameter will be a reading provided by a suitable sensor which detects or determines or reads an information representative of the pressure at the location, for example a vibration sensor providing amplitude readings at the location, when the amplitude readings are representative or indicative of the pressure at the location.

In a first aspect of the present technique, a method for controlling pilot-fuel/pilot-air ratio provided to a burner of a combustion system is presented. The pilot-fuel and the pilot-air are provided to the burner in a ratio of pilot-fuel/pilot-air via a pilot-fuel supply line and a pilot-air supply line, respectively. In the method in step (a) it is determined whether a value of a first parameter equals or exceeds a predetermined maximum limit of the first parameter or not. The first parameter is a factor or quality which tends to move the operating point of the combustion system toward a first undesired region of operation. The value of the first parameter is determined while the pilot-fuel and the pilot-air provided to the burner are in said ratio. Thereafter, in step (b) only if the value of the first parameter so determined equals or exceeds the predetermined maximum limit of the first parameter, then said ratio is changed to a first ratio of pilot-fuel/pilot-air provided to the burner such as to reduce the value of the first parameter to below the predetermined maximum limit of the first parameter. Therefore as a result of step (b) there may be the first ratio or there may still continue to be said ratio. It may be noted that whether it is said ratio maintained after step (b) or it is the first ratio after the step (b), in either case the ratio of the pilot-fuel and pilot-air may be understood to be the first ratio.

After the step (b) a step (c) is performed, in which it is determined if a value of a second parameter equals or exceeds a predetermined maximum limit of the second parameter. The second parameter is a factor or quality which tends to move the operating point of the combustion system toward a second undesired region of operation. The value of the second parameter is determined while the pilot-fuel and the pilot-air provided to the burner are in the first ratio. Finally in a step (d) is performed in which the first ratio is changed to a second ratio of pilot-fuel/pilot-air such as to reduce the value of the second parameter to below the predetermined maximum limit of the second parameter. The first ratio is changed to the second ratio only if the value of the second parameter so determined equals or exceeds the predetermined maximum limit of the second parameter.

Thus, by altering the ratio of the pilot-fuel and the pilot-air provided to the burner, particularly by stopping, initiating, increasing and/or decreasing a flow of the pilot-air to the burner, the operating point is manipulated such that the operating point avoids the undesired regions of operation. For instance when the pilot-fuel and pilot-air ratio is increased e.g. pilot-air is stopped or decreased as compared to the pilot-fuel, the pilot-fuel is either completely non-premixed or richer and thus results in a combustion which lowers dynamics and thus the operating point travels away from an undesired region of high combustion dynamics. On the other hand when the pilot-fuel and pilot-air ratio is decreased e.g. pilot-air is either initiated or increased as compared to the pilot-fuel, the pilot-fuel is either completely premixed or leaner and thus results in a combustion which occurs at lower temperatures and thus the operating point travels away from an undesired region of high tip temperatures resulting into lower emissions. Thus, by using the method of the present technique, the operation of the combustion system within desired regions of operation are achieved.

The method for controlling pilot-fuel/pilot-air ratio provided to a burner of a combustion system may comprise the step of premixing the pilot-fuel and the pilot-air in a desired ratio of the pilot-fuel and pilot-air. This pre-mixing step may be carried out in a pre-mixing chamber, the premixing chamber being formed in the pilot burner. This step of premixing the pilot-fuel and the pilot-air in a desired ratio of the pilot-fuel and pilot-air is carried out before injecting the mixture into a pre-chamber of the combustion system. The desired and pre-mixed mixture of pilot-fuel/pilot-air ratio is then injected into a pre-chamber of the combustion system.

In an embodiment of the method, the first parameter is a temperature of a part of the combustion system and the second parameter is a pressure at a location of a combustion volume of the combustion system. In a related embodiment of the method, the step of (a) includes a step of sensing temperature of the part of the combustion system, and the step (c) a step of sensing pressure information indicative of the pressure at the location of the combustion volume.

In another embodiment of the method, the first parameter is a pressure at a location of a combustion volume and the second parameter is temperature of a part of the combustion system. In a related embodiment of the method, the step of (a) includes a step of sensing pressure information indicative of the pressure at the location of the combustion volume, and the step (c) includes a step of sensing temperature of the part of the combustion system.

In another embodiment, the method includes, prior to step (a), a step of determining a level of load during operation of the combustion system to supply a load to gas turbine. In this embodiment, the steps (a) to (d) are performed if the level of load so determined equals or exceeds a predetermined level of load at which it is desired to carry out steps (a) to (d). Thus, the present method is implemented after the combustion system reaches a predetermined load level. Thus, the method permits build-up of a stable pilot flame at very early stages of start-up of the combustion system.

In another embodiment, the combustion system supplies a load, the method includes a step (e) of performing one or more iterations of step (a) to step (d). When for the steps (a) to (d) are performed for the first time, it is one instance, and is referred to as a first set of steps (a) to (d). When one iteration is made of the steps (a) to (d) then, in addition to the first set, there is a second set of steps (a) to (d). The first set and the second set are performed at different levels of loads during operation of the combustion system. Thus the method is performed at various loads, and may be continuous with the iterations being performed progressively over successive load ranges or may be intermittent where the at least one iterations is performed at a different load level compared to the load level at which the first set is performed but no iterations are performed at load levels in between the two load levels where the first set and the iterations are performed.

In an embodiment alternate to aforementioned embodiment, the method includes a step (e) of performing one or more iterations of step (a) to step (d). In this embodiment, the one or more iterations include at least a third set of steps (a) to (d) and a fourth set of steps (a) to (d) successively performed after the fourth set i.e. at the same load level. For this embodiment, in the step (a) of the fourth set the said ratio is defined as the second ratio of step (d) of the third set. This provides the possibility of repeating the steps (a) to (d) for one or more times at same load levels.

In another embodiment, the combustion system supplies a load and the method includes a step (f) of performing one or more iterations of step (a) to step (e). When one iteration is made of the steps (a) to (e) then, in addition to the first set of steps (a) to (e), there is a second set of steps (a) to (e). The first set of steps (a) to (e) and the second set of steps (a) to (e) are performed at different levels of loads during operation of the combustion system. Thus the method is performed at various loads, and may be continuous with the iterations being performed progressively over successive load ranges or may be intermittent where the at least one iterations is performed at a different load level compared to the load level at which the first set is performed but no iterations are performed at load levels in between the two load levels where the first set and the iterations are performed.

In another embodiment of the method, in changing said ratio to the first ratio in step (b) and/or in changing the first ratio to the second ratio in step (d), the changing is performed by altering a rate of the pilot-air provided to the burner and by maintaining a rate of the pilot-fuel provided to the burner. Thus flow of pilot-fuel is kept constant. This provides the advantage of using the method of the present technique in addition to any of the presently known methods that control the operating point by altering a spilt of pilot-fuel and main-fuel.

In a second aspect of the present technique, a computer-readable storage media having stored thereon instructions executable by one or more processors of a computer system, wherein execution of the instructions causes the computer system to perform the method in accordance with the first aspect of the present technique, is presented. In a third aspect of the present technique, a computer program, which is being executed by one or more processors of a computer system and performs the method in accordance with the first aspect of the present technique, is presented. The computer program may be implemented as computer readable instruction code by use of any suitable programming language, such as, for example, JAVA, C++, and may be stored on the computer-readable storage medium (removable disk, volatile or non-volatile memory, embedded memory/processor, etc.). The instruction code is operable to program a computer or any other programmable device to carry out the intended functions. The computer program may be available from a network, such as the World Wide Web, from which it may be downloaded.

In a fourth aspect of the present technique, a combustion system is presented. The combustion system includes a burner, a combustion volume associated with the burner, a pilot-fuel supply line, a pilot-air supply line, a valve unit, a temperature sensor, a pressure sensor and a control unit. The pilot-fuel supply line provides pilot-fuel to the burner and the pilot-air supply line provides pilot-air to the burner. The valve unit vary or changes, when instructed by the control unit to do so, a ratio of the pilot-fuel and the pilot-air provided to the burner via the pilot-fuel supply line and the pilot-air supply line, respectively. The temperature sensor senses temperature of a part of the combustion system and communicates to the control unit a temperature signal indicative of the temperature, or in other words a value of the temperature, so sensed. The pressure sensor senses pressure information representing a pressure at a location of the combustion volume and communicates to the control unit a pressure signal indicative of the pressure at the location of the combustion volume, or in other words a value of the pressure at the location.

The control unit receives the temperature signal from the temperature sensor and the pressure signal from the pressure sensor. The control unit then controls, based on the temperature signal, the valve unit for changing the ratio of the pilot-fuel and the pilot-air provided to the burner for reducing the temperature of the part of the combustion system to below a predetermined temperature limit. The controlling of the valve unit by the control unit are performed by issuance of instructions or commands from the control unit to the valve unit. The controlling is performed when the temperature equals to or exceeds the predetermined temperature limit. Additionally or alternatively, the control unit controls, based on the pressure signal, the valve unit for changing the ratio of the pilot-fuel and the pilot-air provided to the burner for reducing the pressure at the location of the combustion volume to below a predetermined pressure limit. The controlling of the valve unit by the control unit is performed by issuance of instructions or commands from the control unit to the valve unit. The controlling is performed when the pressure equals to or exceeds the predetermined pressure limit. The advantages stem from the introduction of pilot-air into along with the pilot-fuel, and are same as the aforementioned advantages stated in accordance with the first aspect of the present technique.

In an embodiment of the combustion system, the burner comprises a burner face. The burner face has a plurality of pilot-fuel injection holes and a plurality of pilot-air injection holes. Each pilot-fuel injection hole is fluidly connected to the pilot-fuel supply line and each pilot-air injection hole is fluidly connected to the pilot-air supply line. This provides an embodiment of the burner equipped with capability of delivering or providing the pilot-air to the burner, along with the pilot-fuel.

In another embodiment of the combustion system, the combustion system includes a premixing chamber. In the premixing chamber the pilot-fuel and the pilot-air are mixed in a desired ratio of the pilot-fuel and pilot-air. The premixing chamber is fluidly connected to the pilot-fuel supply line and the pilot-air supply line, and includes an outlet that provides a mix of pilot-fuel and the pilot-air premixed in the desired ratio. This provides an embodiment of the burner equipped with capability of delivering or providing the pilot-air to the burner, premixed along with the pilot-fuel, i.e. the pilot-air and the pilot-fuel are mixed before being injected into the combustion chamber.

In a fifth aspect of the present technique, a gas turbine engine comprising at least one combustion system is presented. The combustion system is according to the aforementioned fourth aspect of the present technique.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DETAILED DESCRIPTION OF INVENTION

Figure 1:
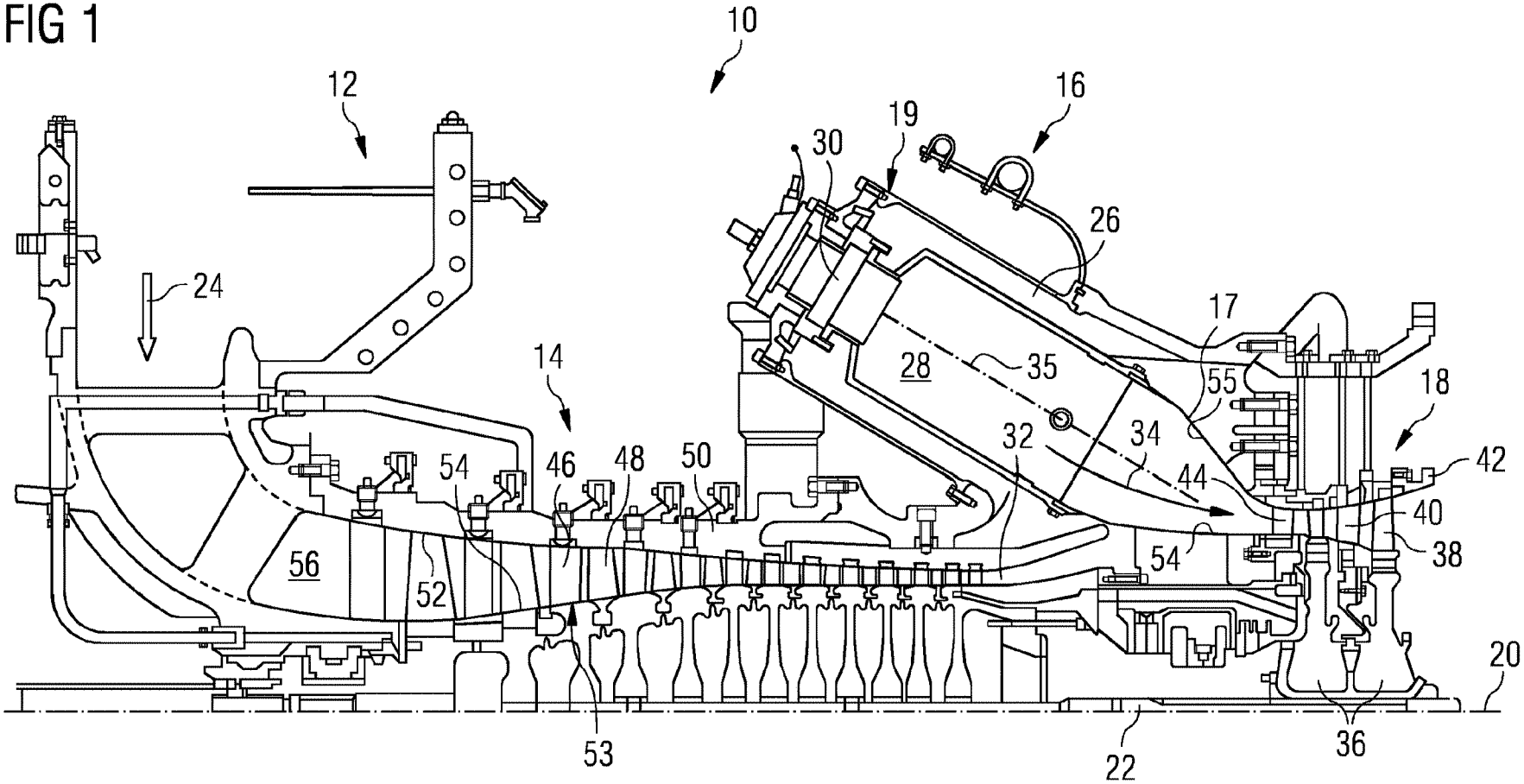
FIG. 1 shows part of a gas turbine engine in a sectional view and in which a combustion system of the present technique is incorporated.

Hereinafter, above-mentioned and other features of the present technique are described in details. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine engine 10 in a sectional view. The gas turbine engine 10 comprises, in flow series, an inlet 12, a compressor or compressor section 14, a combustor section 16 and a turbine section 18 which are generally arranged in flow series and generally about and in the direction of a rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, a combustion volume 28 extending along a longitudinal axis 35 and at least one burner 30 fixed to the combustion volume 28. The combustion volume 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion volume 28 to the turbine section 18 via a transition duct 17.

This exemplary gas turbine engine 10 has a cannular combustor section arrangement 16, which is constituted by an annular array of combustor cans 19 each having the burner 30 and the combustion volume 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas 34 from the combustion volume 28 enters the turbine section 18 and drives the turbine blades 38 which in turn rotate the rotor. The guiding vanes 40, 44 serve to optimise the angle of the combustion or working gas 34 on the turbine blades 38.

The turbine section 18 drives the compressor section 14. The compressor section 14 comprises an axial series of vane stages 46 and rotor blade stages 48. The compressor section 14 also comprises a casing 50 that surrounds the rotor stages and supports the vane stages 46. The guide vane stages include an annular array of radially extending vanes that are mounted to the casing 50. The casing 50 defines a radially outer surface 52 of the passage 56 of the compressor 14. A radially inner surface 54 of the passage 56 is at least partly defined by a rotor drum 53 of the rotor which is partly defined by the annular array of rotor blade stages 48.

The present technique is described with reference to the above exemplary turbine engine having a single shaft or spool connecting a single, multi-stage compressor and a single, one or more stage turbine. However, it should be appreciated that the present technique is equally applicable to two or three shaft engines and which can be used for industrial, aero or marine applications. Furthermore, the cannular combustor section arrangement 16 is also used for exemplary purposes and it should be appreciated that the present technique is equally applicable to annular type and can type combustors.

The terms axial, radial and circumferential are made with reference to the rotational axis 20 of the engine, unless otherwise stated. The present technique presents a combustion system 1 (shown in FIGS. 3 to 5) that is incorporated in a gas turbine engine, such as the gas turbine engine 10 of FIG. 1. Before explaining details of the combustion system 1 of the present technique, it will be beneficial for understanding of the present technique if we briefly look at a conventionally known combustor 15 as shown schematically in FIG. 2.

Figure 2:
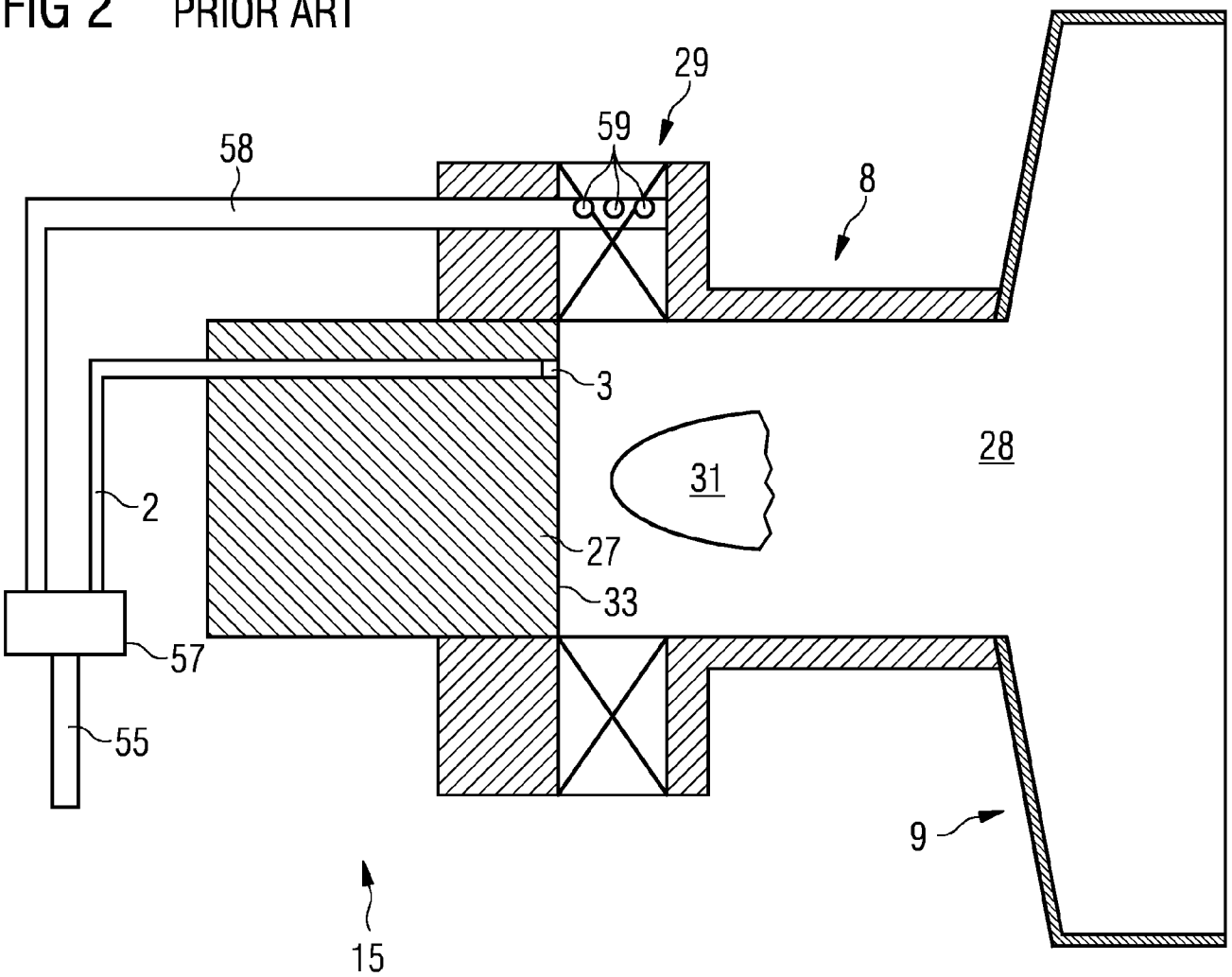
FIG 2 PRIOR ART
FIG. 2 schematically illustrates a sectional view of a conventionally known combustor that is different from the combustion system of the present technique.

Part of a typical conventional combustor 15 schematically shown in FIG. 2 has a conventional burner 27 having a burner surface 33, a swirler 29, and a combustion volume 28 generally formed of a burner pre-chamber 8 and a combustion chamber 9. Main-fuel is introduced into the swirler 29 by way a main-fuel supply line 58, while pilot-fuel enters the combustion volume 28 through the burner 27, particularly though pilot-fuel injection holes 3 located on the burner surface 33, also referred to as the burner face 33 through a conduit 2 called as pilot-fuel supply line 2. The main-fuel supply line 58 and the pilot-fuel supply line 2 are derived from a fuel-split valve 57, which is fed with a fuel supply 55 representing the total fuel supply to the combustor 15.

The main-fuel via the main-fuel supply line 58 enters the swirler 29 and is ejected out of a set of main-fuel nozzles (or injector) 59, from where the main-fuel is guided along swirler vanes (not shown), being mixed with incoming compressed air in the process. The resulting swirler-air/main-fuel mixture maintains a burner flame 31. The hot air from this flame 31 enters the combustion volume 28. As is shown in FIG. 2, the air is supplied to the conventionally known combustor 15 via the swirler 29 and mixed with the main-fuel supplied via the main-fuel nozzles 59. In the conventionally known burner 27 or combustors 15 there is no provision or function of any air supplied through the burner surface 33, either premixed with pilot-fuel or injected into the combustion volume 28 simultaneously and adjacently with the pilot-fuel. The present technique in contrast introduces pilot-air, as shown in exemplary embodiments of FIGS. 3 and 4.

Figure 3:
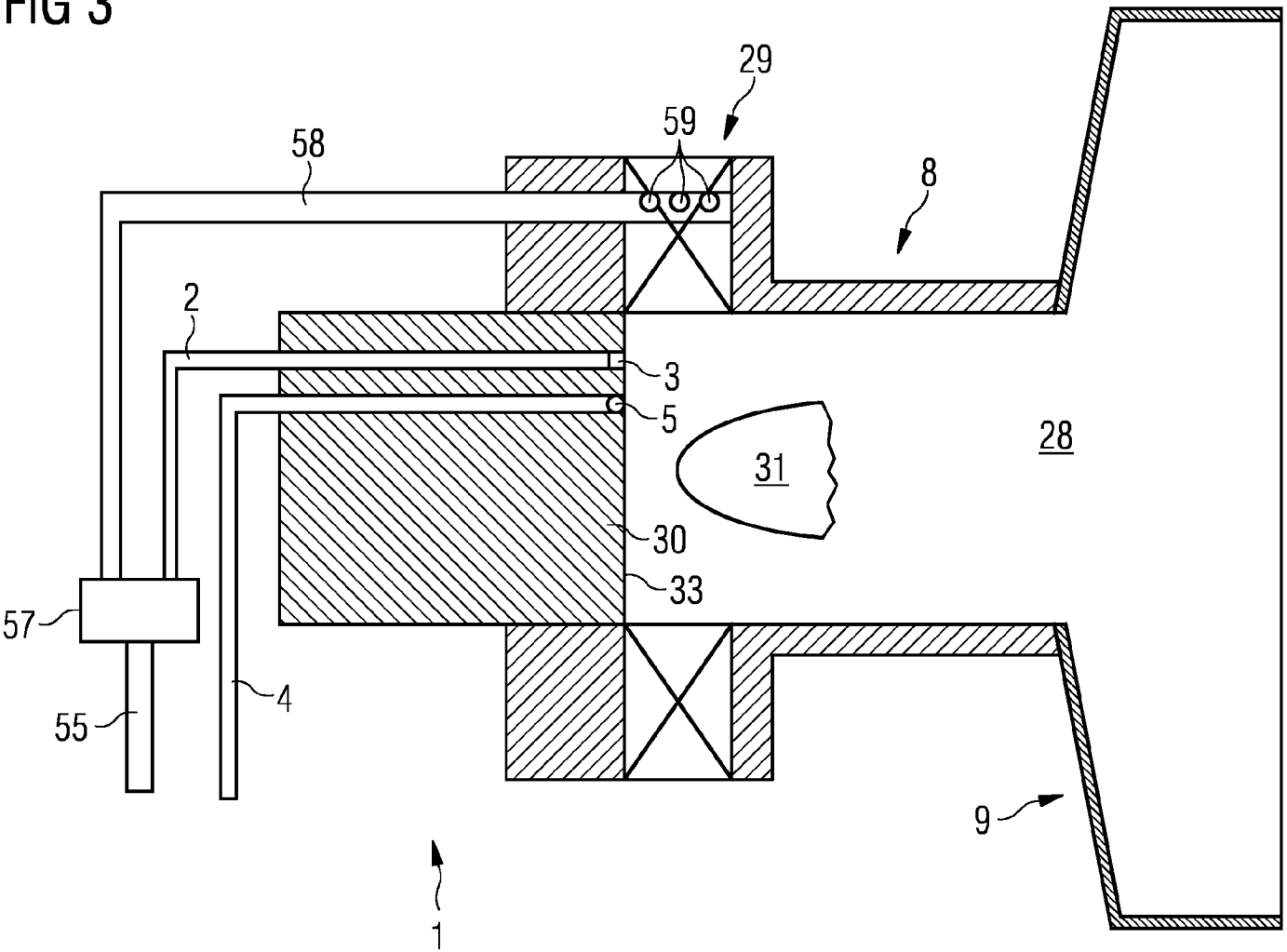
FIG. 3 schematically illustrates an exemplary embodiment of the combustion system of the present technique.
Figure 4:
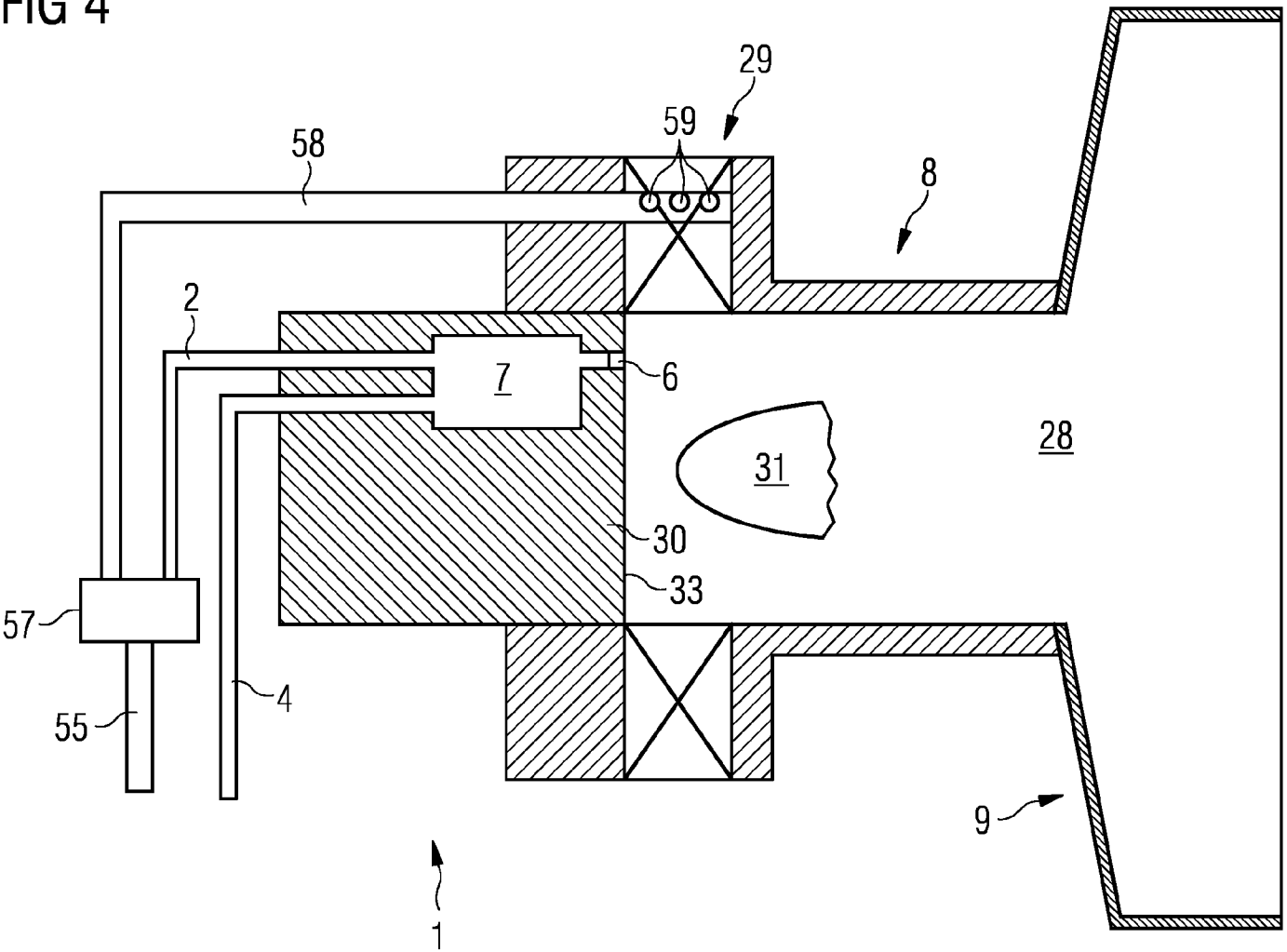
FIG. 4 schematically illustrates another exemplary embodiment of the combustion system of the present technique.

FIG. 3 and FIG. 4 schematically represent two exemplary embodiment of a combustion system 1 according to aspects of the present technique. The combustion system 1 having the combustor volume 28, i.e. seat of combustion, includes the swirler 29, for example a radial swirler, and the burner 30 having the burner surface 33 which is face or surface of the burner 30 that is contiguous with and facing the combustion volume 28. The combustion volume 28 is formed by space circumferentially enclosed, with respect to the axis 28 shown in FIG. 1, by the burner pre-chamber 8 and the combustion chamber 9. Similar to the FIG. 2, the burner 30 includes main-fuel supply line 58 for introducing the main-fuel into the swirler 29 through the main-fuel nozzles 59. The main-fuel supply line 58 and the pilot-fuel supply line 2 are fed by the fuel supply 55, representing the total fuel supply to the combustion system 1, and their respective ratios (pilot-fuel to main-fuel) at different load levels of operation of the combustion system 1 are controller by the fuel-split valve 57. The fuel-split valve 57 is well known and thus not described herein in further detail for sake of brevity. The fuel-split valve 57 is generally controlled by an engine control unit (not shown in FIGS. 3 and 4) which instructs the fuel-split valve 57 to split total fuel at a given load level to the pilot-fuel supplied to the burner 30 and to the main-fuel injected into the combustor volume 28 via the main-fuel nozzles 59. The split is performed, under the instructions of the engine control unit, either abiding by a default split map or by calculated/adjusted split as achieved from a monitoring and control techniques, for example as aforementioned in WO 2007/082608, EP 2442031 A1, WO 2011/042037 A1, or WO 2015/071079 A1, all of which are incorporated herein by reference.

Figure 6:
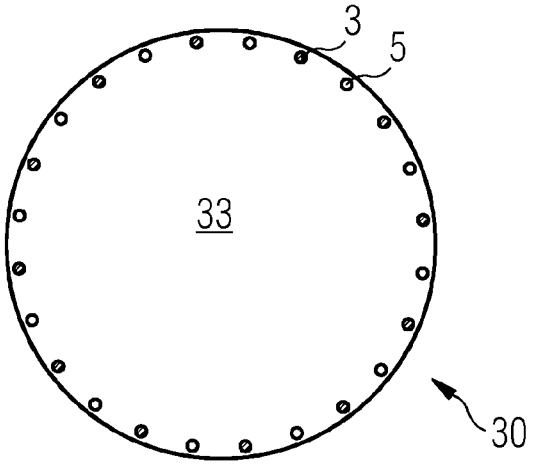
FIG. 6 schematically illustrates an exemplary embodiment of a burner face/surface of the embodiment of the combustion system shown in FIG. 3.

As shown in FIG. 3, the pilot-fuel is supplied, via the pilot-fuel injection line 2, through the burner 30 and into the combustor volume 28 injected through the pilot-fuel injection holes 3, hereinafter also referred to as the pilot holes 3 that are located on the burner surface 33, also referred to as the burner face 33. As depicted in FIG. 3, the burner face 33 besides having pilot holes 3, also has a plurality of pilot-air injection holes 5, as shown schematically in FIG. 6 which represents the burner face 33 and shows a plurality of alternately arranged pilot holes 3 and the pilot-air injection holes 5. Although one pilot-air injection hole 5, hereinafter also referred to as the pilot-air hole 5, is shown in FIG. 3, generally on the burner face 33 or the burner surface 33, a plurality of pilot-fuel holes 3 and a plurality of pilot-air holes 5 are present as shown in FIG. 6. In this embodiment of the combustion system 1, hereinafter also referred to as the system 1, each pilot-fuel hole 3 is fluidly connected to the pilot-fuel supply line 2 and each pilot-air hole 5 is fluidly connected to the pilot-air supply line 4. The pilot-air and the pilot-fuel are both capable of being injected into the combustion volume 28, particularly through the burner surface 33, independently of each other, either successively or simultaneously.

In this embodiment of the system 1, the pilot-fuel and the pilot-air may be successively or simultaneously provided to the combustion volume 28 in any desired ratio, for example if no pilot-air is provided though the pilot holes 5 but only pilot-fuel is supplied though the pilot holes 3, then the combustion volume 28 receives only pilot-fuel i.e. rich pilot-fuel. On the other hand when the pilot-fuel and the pilot-air are provided simultaneously from the pilot holes 3 and the air holes 5 at equal rates, then a desired ratio of 1:1 is achieved in the combustion volume 28. Similarly, when the pilot-fuel is provided from the pilot holes 3 at a rate that is three times a rate of simultaneously provided pilot-air from the air holes 5, then a desired ratio of 3:1 is achieved in the combustion volume 28.

As shown in FIG. 4, in another embodiment of the system 1, the pilot-fuel is supplied, via the pilot-fuel injection line 2, through the burner 30 and into a premixing chamber 7 formed in the burner 30. The pilot-air supply line 4 also connects to, and thus supplies, the premixing chamber 7 with the pilot-air. Alternatively, in another embodiment (not shown), the premixing chamber 7 may be formed outside the burner 30 or in yet another embodiment (not shown) the pilot-fuel supply line 2 may function as the premixing chamber 7 when pilot-air is directly introduced into the pilot-fuel supply line 2 via the pilot-air supply line 4. The pilot-air, if and when supplied to the premixing chamber 7, mixes with the pilot-fuel to form mix of pilot-fuel and pilot-air, which is pre-mixed before being supplied to the combustor volume 28 injected through an outlet 6, hereinafter also referred to as the hole 6, that is located on the burner surface 33. Although FIG. 4 shows only one outlet 6, it may be noted that a plurality of outlets 6 are generally present on the burner face 33, and their arrangement may be understood by only envisioning say the holes 3 on the surface 33 as shown in FIG. 6. In this embodiment of the system 1, the pilot-fuel and the pilot-air may be mixed in the premixing chamber 7 in any desired ratio, for example if no pilot-air is provided to the premixing chamber 7 but only pilot-fuel is supplied, then the outlet 6 is capable of providing to the combustion volume 28 only pilot-fuel i.e. non-premixed pilot-fuel. On the other hand the pilot-fuel and the pilot-air may be mixed in the premixing chamber 7 in equal amounts, and then a desired ratio of 1:1 is achieved and then the outlet 6 is capable of providing to the combustion volume 28 a premixed pilot-fuel having equal amount of the pilot-air. Similarly, the pilot-fuel and the pilot-air may be mixed in the premixing chamber 7 in 3:1 ratio, and then the outlet 6 is capable of providing to the combustion volume 28 the premixed pilot-fuel having 75% pilot-fuel mixed with 25% pilot-air.

Figure 5:
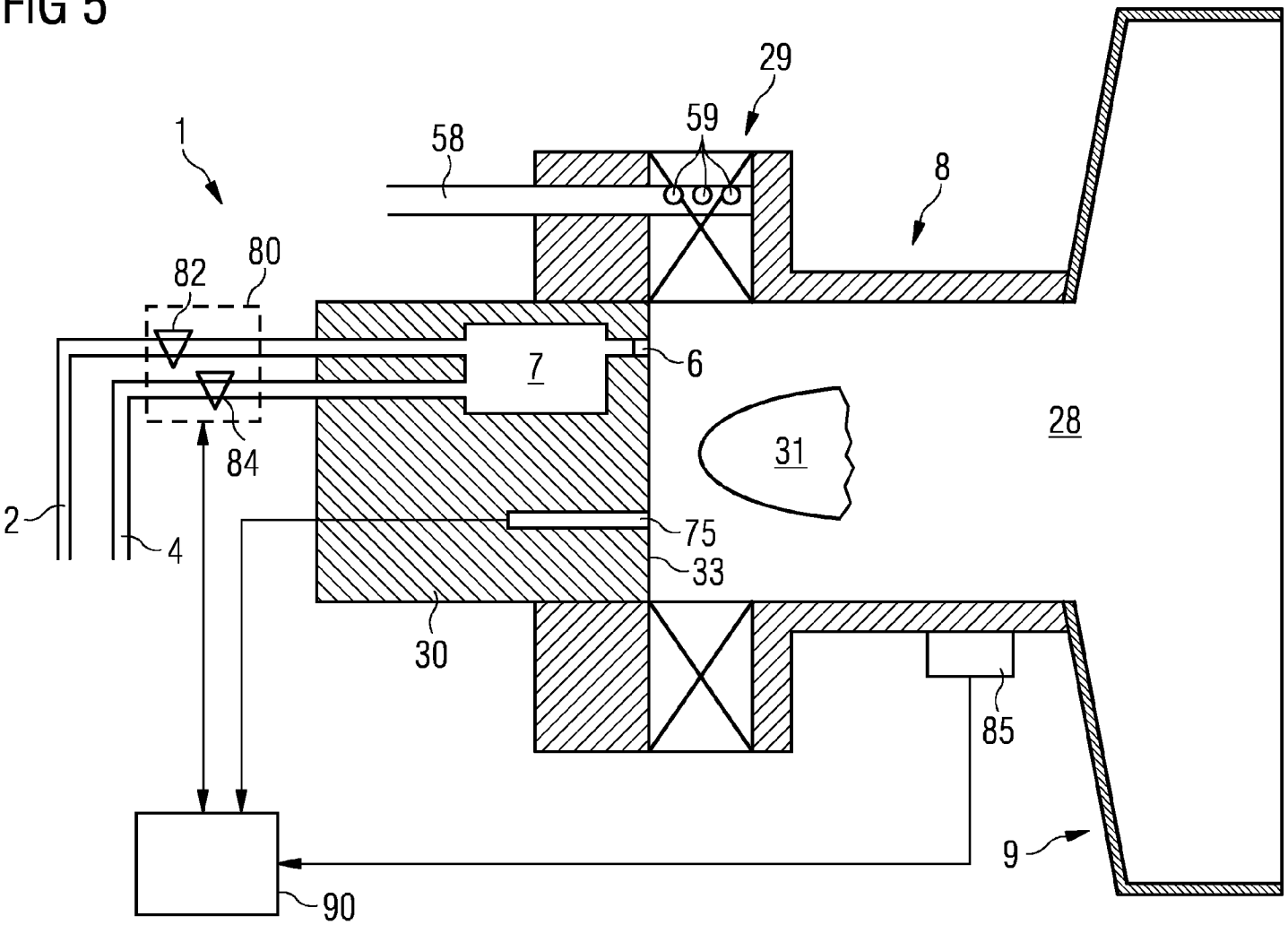
FIG. 5 schematically illustrates yet another exemplary embodiment of the combustion system of the present technique.

FIG. 5 schematically shows further details of the combustion system 1. The system 1, besides the burner 30 having the burner surface 33 and the combustion volume 28, the pilot-fuel supply line 2 for providing pilot-fuel to the burner 30, the pilot-air supply line 4 for providing pilot-air to the burner 30, also includes a valve unit 80, a temperature sensor 75, a pressure sensor 85 and a control unit 90. It may be noted that FIG. 5 has been shown as an example to correspond to the embodiment of FIG. 4, however the further description of FIG. 5 provided hereinafter is equally applicable to the embodiment of FIG. 3.

The valve unit 80 functions to vary a ratio of the pilot-fuel and the pilot-air provided to the burner 30 via the pilot-fuel supply line 2 and the pilot-air supply line 4, respectively, by initiating, changing or stopping supply of one or both of the pilot-fuel and the pilot-air provided to the burner 30 via the pilot-fuel supply line 2 and the pilot-air supply line 4. The valve unit 80 may include a pilot-fuel valve 82 which controls the flow of pilot-fuel into the premixing chamber 7, and therefore to the combustion volume 28 (or directly to the combustion volume 28 in embodiment of FIG. 3). The valve unit 80 may also include a pilot-air valve 84 which controls the flow of pilot-air into the premixing chamber 7, and therefore to the combustion volume 28 (or directly to the combustion volume 28 in embodiment of FIG. 3). The valve unit 80 is controlled, i.e. instructed about the ratio of the pilot-fuel and the pilot-air, by instructions received from the control unit 90. The valve unit 80 furthermore reports an existing ratio to the control unit 90.

The temperature sensor 75 senses temperature of a part, for example, but not limited to, the burner surface 33, of the combustion system 1. The temperature sensor 75 may be a thermocouple embedded into the burner 30 and which communicates a temperature signal to the control unit 90. The temperature signal thus received by the control unit 90 is indicative of the temperature so sensed of the part 33 or the burner surface 33. The pressure sensor 85 senses pressure information, for example, but not limited to, amplitude or frequency of pressure vibrations, representing a pressure at a location of the combustion volume 28. The location of the combustion volume 28 is depicted for exemplary purposes as a body of the pre-chamber 8. The pressure sensor 85 then communicates a pressure signal, to the control unit 90, indicative of the pressure at the location, i.e. the pre-chamber 8 volume in example of FIG. 5, of the combustion volume 28. The positions of the temperature sensor 75 and the pressure sensor 85 are depicted in FIG. 5 are for exemplary purposes only, and it may be appreciated by one skilled in the art of monitoring operating characteristics of a combustor that the temperature sensor 75 and the pressure sensor 85 may be positioned in various other places in the combustion system 1, some of which are indicated in WO 2007/082608, and are incorporated herein by reference.

The control unit 90 receives the temperature signal from the temperature sensor 75 and the pressure signal from the pressure sensor 85. The control unit 90, which may be but not limited to a data processor, a microprocessor, a programmable logic controller may be either a separate unit or a part of the engine control unit (not shown) that monitors or regulates one or more operating parameters of the gas turbine engine 10. The control unit 90, based on the temperature signal, instructs or directs the valve unit 80, through one or more output signals sent to the valve unit 82, for changing the ratio of the pilot-fuel and the pilot-air provided to the burner 30. This change as instructed by the control unit 90 is such that the temperature of the part 33 of the combustion system 1 is reduced to below a predetermined temperature limit, when the temperature equals to or exceeds the predetermined temperature limit. This aspect has been explained further in relation to FIGS. 8 and 9. Furthermore, the control unit 90, based on the pressure signal, instructs or directs the valve unit 80, through one or more output signals sent to the valve unit 82, for changing the ratio of the pilot-fuel and the pilot-air provided to the burner 30. This change as instructed by the control unit 90 is such that the pressure at the location i.e. the pre-chamber 8 of the combustion system 1 is reduced to below a predetermined pressure limit, when the pressure equals to or exceeds the predetermined pressure limit. This aspect has also been explained further in relation to FIGS. 8 and 9.

Figure 7:
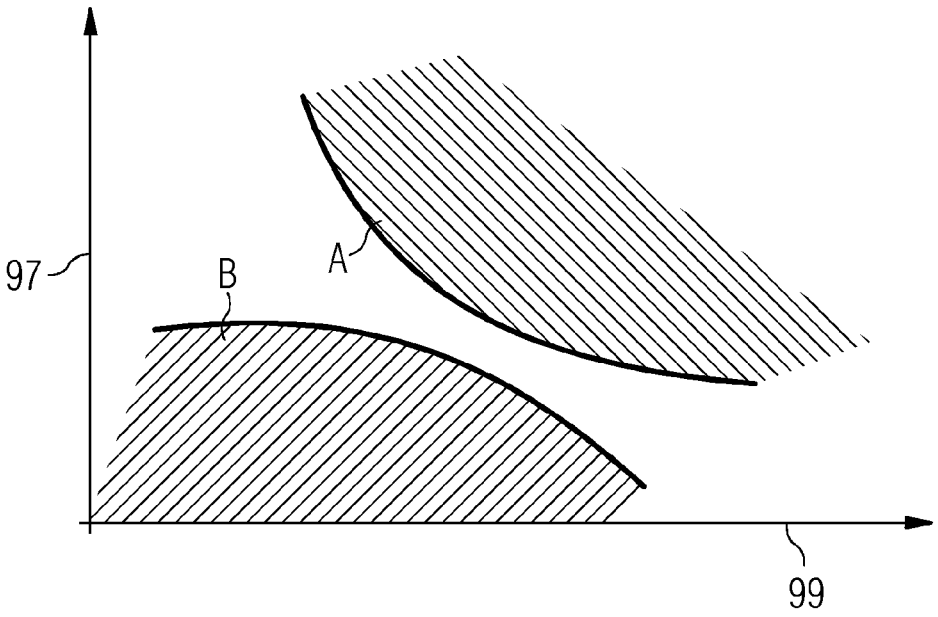
FIG. 7 schematically illustrates a default split curve.
Figure 8:
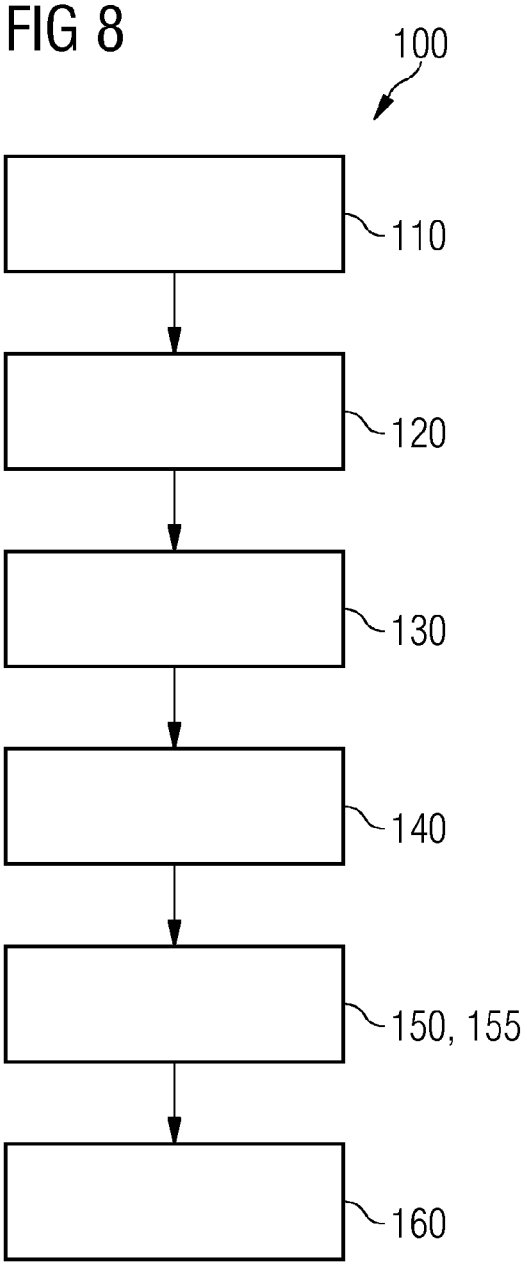
FIG. 8 depicts a flow chart representing an exemplary embodiment of a method of the present technique.
Figure 9:
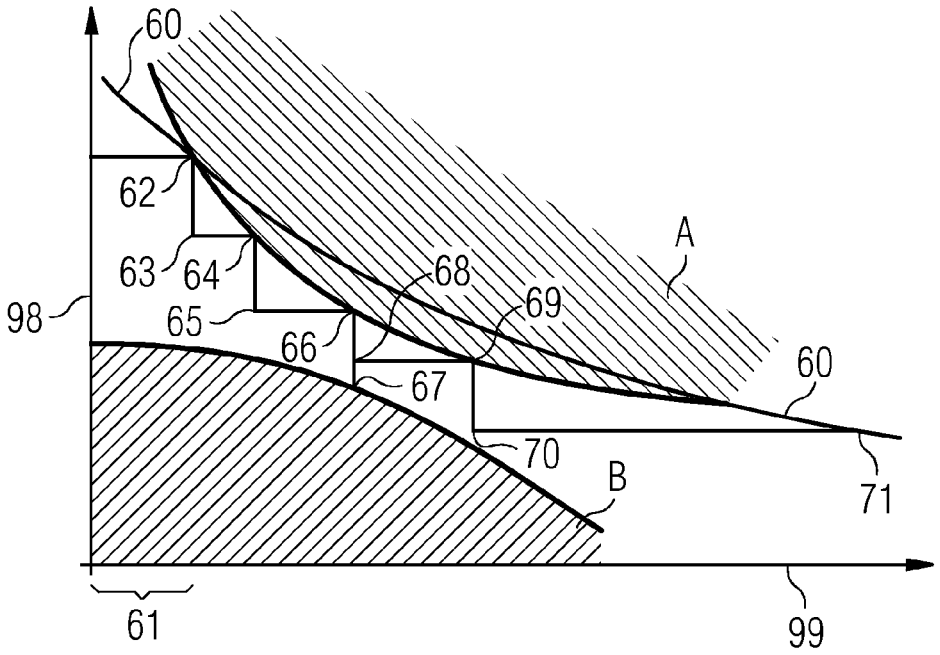
FIG. 9 schematically illustrates an effect on operating point as a result of the method of FIG. 8; in accordance with aspects of the present technique.

FIG. 8 and FIG. 9 have been referred to, hereinafter, to explain an exemplary embodiment of a method 100 of the present technique and an effect of the method 100 of the present technique. The system 1 of FIG. 5 explained earlier may be used for implementing an exemplary embodiment of the method 100 of FIG. 8. For better understanding of the effect of the method 100, FIG. 7 is provided that schematically illustrates sets of operating parameters corresponding to predefined operating stages according to embodiments of the herein disclosed subject matter.

In FIG. 7, a graph of pilot-fuel to total fuel split over the load of the gas turbine is presented. The horizontal axis 99 represents low loads of the gas turbine on the left hand side and high loads on the right hand side. The vertical axis 97 represents a fuel split with a higher amount of the pilot-fuel flow at the upper range of the vertical axis 97 and less pilot-fuel flow at the lower range of the vertical axis 97. The vertical axis 97 does not show absolute values of pilot-fuel supply but the relative value of the pilot-fuel supply, i.e. fuel supplied by the pilot-fuel supply line 2 of FIGS. 3 and 4, in comparison to total fuel supply i.e. fuel supplied by the fuel supply line 55 of FIGS. 3 and 4.

According to an embodiment, the hatched area referenced as A in FIG. 2 represents a set of operating conditions in which a component part, or simply the part, such as the burner surface 33 of FIGS. 3 and 4, of the combustion system 1 are in danger of suffering damage due to overheating. For example there may be conditions in which a specific pilot-fuel split will result in overheating of the burner surface 33 for a given load. According to embodiments of the herein disclosed subject matter, the control unit 90 of FIG. 5 is configured for providing instructions or the output signal to the valve unit 80 of FIG. 5 so as to effect, for a given load, a division (split) between the pilot-fuel and pilot-air such that area A is avoided.

According to other embodiments, the control unit 90 is configured for providing instructions or the output signal to the valve unit 80 so as effect a ratio between the pilot-fuel and the pilot-air such that area B is avoided. According to an embodiment, the area B represents a set of operating conditions in which the amplitude of dynamic pressure oscillations in the combustion volume 28, and particularly in a region of the combustion volume 28 circumferentially enclosed by the pre-chamber 8, is undesirably high. When such dynamic pressure oscillations equal or exceed acceptable levels, the operation of the gas turbine and/or the mechanical longevity of the combustion system 1 can be severely impacted.

Hence it is desirable to keep operating point away from the undesired region B i.e. the area B as well as from the undesired region A i.e. the area A. This is realised according to embodiments of the method 100 and the system 1 herein disclosed subject matter.

FIG. 9 shows a curve 60 which is an exemplary default split or a calculated split of the pilot-fuel to total fuel over progressing load of the combustion system 1, i.e. the gas turbine engine 10, or in other words the curve 60 represents locus of the operating point as achieved by implementing the default split or by implementing a calculated split by using any of the conventionally known monitoring and control techniques for pilot-fuel and main-fuel split. The deviations from the curve 60 represented by line segments between different points, for example between a point 62 and a point 63, and between a point 64 and a point 65, and between a point 66 and a point 67, and between a point 67 and a point 68, and between a point 69 and a point 70, etc. are navigations of the operating point achieved by altering the ratio of the pilot-fuel to the pilot-air, advantageously keeping the pilot-fuel to total fuel ratio at constant for a given load level, and only altering the pilot-air amounts to change or vary the pilot-fuel and pilot-air ratio.

The horizontal axis 99 represents low loads of the gas turbine on the left hand side and high loads on the right hand side. The vertical axis 98 represents a pilot-fuel and pilot-air split i.e. pilot-fuel/pilot-air ratio, with a higher amount of the pilot-fuel flow, i.e. lower amount of pilot-air flow keeping the pilot-fuel flow constant, at the upper range of the vertical axis 98 and less pilot-fuel flow, i.e. higher amount of pilot-air flow keeping the pilot-fuel flow constant, at the lower range of the vertical axis 98. The vertical axis 98 does not show absolute values of pilot-fuel and pilot-air but the relative value of the pilot-fuel and pilot-air supply to the combustor volume 28, which may be achieved in form of premixed pilot-fuel and pilot-air as applicable for embodiments of the system 1 depicted in FIGS. 4 and 5, or may be achieved in form of simultaneously but independently injecting pilot-fuel and pilot-air as applicable for embodiment of the system 1 depicted in FIG. 3.

In the method 100, first it is determined 110 in a step (a) whether a value of a first parameter, for example one of the temperature of the part 33 or the pressure of pre-chamber 8, equals or exceeds a predetermined maximum limit of the first parameter. The value of the first parameter is determined while the pilot-fuel and the pilot-air provided to the burner 30 are in a given ratio. The first parameter pertains to an operating characteristic which tends to move the operating point towards a first undesired region A of operation. Thereafter in the method 100, in a step (b) said ratio is changed 120 to a first ratio of pilot-fuel/pilot-air, if the value of the first parameter so determined 110 equals or exceeds the predetermined maximum limit of the first parameter. Now, the pilot-fuel and the pilot-air are provided to the burner 30 in the first ratio. If no change is done in the step (b), then pilot-fuel and pilot-air are continued to be provided in the given ratio i.e. the initial ratio. The changed ratio, i.e. the first ratio, is such that operating the combustion system 1 at that ratio results in reduction of the value of the first parameter to below the predetermined maximum limit of the first parameter.

The step (a) and the step (b) are explained further with reference to FIG. 9. For the purposes of explanation of FIG. 9, the first parameter is assumed to be temperature of the part 33. Now when the system 1 is being operated at any point within load level represented by range of load level 61 on the axis 99, and when the value of the first parameter, i.e. temperature from the thermocouple 75, is compared to the predetermined maximum temperature limit for that load level, it is found that the value of the temperature sensed by the thermocouple 75 does not equal or exceed the predetermined maximum temperature limit. Thus in the step (a) of the method 100, the value of the temperature sensed does not exceed or equal the predetermined maximum temperature limit, and thus no change in ratio of the pilot-fuel and pilot-air is performed in the step (b). Therefore within the load range 61 no deviations from the default split are required and thus pilot-fuel to pilot-air ratio may be kept constant, for example, no pilot-air may be supplied to the combustion volume 28, and thus the pilot-fuel may be said to be supplied in non-premixed mode.

The operating point then continues, controlled by the pilot-fuel to total fuel split, to progress in the load. Finally at the point 62, the pilot-fuel to total fuel split is such that the operating point is in contact with the undesired region A, i.e. in other words the temperature of the part 33 as sensed by the thermocouple 75, for the corresponding level of load depicted by axis 99, has become equal to the predetermined maximum temperature limit for the corresponding level of load, and thus as a result of step (a) it is determined that the value of the first parameter is equal to (or could be similarly understood to exceed) the predetermined maximum temperature limit. Thereafter in step (b), the ratio of the pilot-fuel and pilot-air is changed to the first ratio, i.e. in the example of FIG. 9, the pilot-air amount is increased, which may be achieved by opening the pilot-air valve 84 of the valve unit 80. As a result of the new ratio of the pilot-fuel and pilot-air, i.e. the first ratio, the operating point moves away from the undesired region A, i.e. the temperature of part 33 drops below or becomes lower than the predetermined maximum temperature limit for the corresponding load level. The pilot-air makes the pilot-fuel combust at lower temperatures due to leaner stoichiometry of the pilot-fuel achieved by premixing or simultaneously injecting pilot-air.

As shown in FIG. 8, in the method 100, thereafter it is determined 130 in a step (c) whether a value of a second parameter, for example other of the temperature of the part 33 or the pressure of pre-chamber 8, equals or exceeds a predetermined maximum limit of the second parameter. The value of the second parameter is determined while the pilot-fuel and the pilot-air provided to the burner 30 are in the first ratio. The second parameter pertains to an operating characteristic which tends to move the operating point toward a second undesired region B of operation. Thereafter in the method 100, in a step (d) the first ratio is changed 140 to a second ratio of pilot-fuel/pilot-air, if the value of the second parameter so determined 130 equals or exceeds the predetermined maximum limit of the second parameter. Thereafter the pilot-fuel and the pilot-air are provided to the burner 30 in the second ratio. If no change is done in step (d), then pilot-fuel and pilot-air are continued to be provided in the first ratio. The changed ratio, i.e. the second ratio, is such that operating the combustion system 1 at that ratio results in reduction of the value of the second parameter to below the predetermined maximum limit of the second parameter.

The step (c) and the step (d) are explained further with reference to FIG. 9. For the purposes of explanation of FIG. 9 and continuing the example of FIG. 9, the second parameter is assumed to be pressure of the pre-chamber 8. Now when the system 1 is being operated at the point 63, i.e. having the first ratio of pilot-fuel/pilot-air, and when the value of the second parameter, i.e. pressure from the pressure sensor 85, is compared to the predetermined maximum pressure limit for that load level, it is found that the value of the pressure sensed by the pressure sensor 85 does not equal or exceed the predetermined maximum pressure limit, i.e. the point 63 does not coincide or fall in the undesired region B of FIG. 9. Thus in the step (c) of the method 100, the value of the pressure sensed does not exceed or equal the predetermined maximum pressure limit, and thus no change in ratio of the pilot-fuel and pilot-air is performed in the step (d). Therefore at the load level corresponding to the point 63 no further ratio change is required and thus pilot-fuel to pilot-air ratio may be kept constant, i.e. at the first ratio.

Further continuing the above example of FIG. 9, the operating point then continues from the point 63 to the point 64, controlled by the pilot-fuel to total fuel split, to progress in the load, and during this operation between the points 63 and 64, the pilot-fuel to the pilot-air ratio is kept at the first ratio that was determined at the point 63. Thereafter, at the point 64, the pilot-fuel to total fuel split is such that the operating point is again in contact with the undesired region A, albeit at a different load level i.e. in other words the temperature of the part 33 as sensed by the thermocouple 75, for the corresponding level of load depicted by axis 99, has become once again equal to the predetermined maximum temperature limit for the corresponding level of load, and thus as a result of step (a) it is determined that the value of the first parameter is equal to the predetermined maximum temperature limit. Thereafter in step (b), the ratio of the pilot-fuel and pilot-air is reset or adjusted to a newer ratio, i.e. in the example of FIG. 9, the pilot-air amount is increased, which may be achieved by opening the pilot-air valve 84 of the valve unit 80. As a result of the new ratio of the pilot-fuel and pilot-air, the operating point moves away from the undesired region A, to the point 65, i.e. the temperature of part 33 drops below or becomes lower than the predetermined maximum temperature limit for the corresponding load level. The pilot-air makes the pilot-fuel combust at lower temperatures due to leaner stoichiometry of the pilot-fuel achieved by premixing or simultaneously injecting pilot-air.

At this stage of the method 100, the steps (c) and (d) are performed again, however it is seen that the value of the second parameter i.e. the pressure is still not coinciding or falling in the undesired region B, so no changes in ratio are performed. This completes one iteration of the steps (a) to (d) performed at different load level. A first set of steps (a) to (d) were performed at load level corresponding to the points 62 and 63 and a second set of steps (a) to (d) were performed at load level corresponding to the points 64 and 65.

Still continuing the above example of FIG. 9, the operating point then continues from the point 65 to the point 66, controlled by the pilot-fuel to total fuel split. Thereafter, at the point 66, the pilot-fuel to total fuel split is such that the operating point is yet again in contact with the undesired region A, albeit at yet another load level i.e. in other words the temperature of the part 33 as sensed by the thermocouple 75, for the corresponding level of load depicted by axis 99, has become once again equal to the predetermined maximum temperature limit for the corresponding level of load, and thus as a result of step (a) it is determined that the value of the first parameter is equal to the predetermined maximum temperature limit. Thereafter in step (b), the ratio of the pilot-fuel and pilot-air is reset or adjusted to a newer ratio, i.e. in the example of FIG. 9, the pilot-air amount is increased, which may be achieved by opening the pilot-air valve 84 of the valve unit 80, as aforementioned. As a result of the new ratio of the pilot-fuel and pilot-air, the operating point moves away from the undesired region A, to the point 67, i.e. the temperature of part 33 drops below or becomes lower than the predetermined maximum temperature limit for the corresponding load level.

At this stage of the method 100, the steps (c) and (d) are performed again, however it is seen that the value of the second parameter i.e. the pressure is now coinciding or falling in the undesired region B, i.e. in other words the pressure of the pre-chamber 8 as sensed by the pressure sensor 85, for the corresponding level of load depicted by axis 99, has become equal to the predetermined maximum pressure limit for the corresponding level of load, and thus as a result of step (c) it is determined that the value of the second parameter is equal to (or could be similarly understood to exceed) the predetermined maximum pressure limit. Thereafter in step (d), the ratio of the pilot-fuel and pilot-air is changed to the second ratio, i.e. in the example of FIG. 9, the pilot-air amount is decreased, which may be achieved by closing or tightening the pilot-air valve 84 of the valve unit 80. As a result of the new ratio of the pilot-fuel and pilot-air, i.e. the second ratio, the operating point moves away from the undesired region B, to the point 68 i.e. the pressure of the pre-chamber 8 drops below or becomes lower than the predetermined maximum pressure limit for the corresponding load level.

The steps (a) and (b) are then repeated at the point 68, and it is seen that the value of the temperature does not equal or exceed the predetermined maximum temperature limit. However, if the value of the temperature had equaled or exceeded the predetermined maximum temperature limit, then step (b) would have been performed and thereafter followed by steps (c) and (d). This would have completed one iteration of the steps (a) to (d) performed at same load level. A third set of steps (a) to (d) were performed at load level corresponding to the points 66 and 68 and a fourth set of steps (a) to (d) would also be performed at same load level i.e. load levels corresponding to the points 66 and 68.

Similar navigation of the operating point is performed at the load level corresponding to the points 69 and 70. Thereafter after the point 71, since the undesired regions A and B are cleared in operation of the combustion system 1, the method 100 may be concluded. It may be noted that in the above explanation the first parameter was selected to be the temperature and the second parameter was selected to be the pressure for exemplary purpose only. In another embodiment of the method 100, the first parameter may be selected to be the pressure and the second parameter may be selected to be the temperature. Furthermore, before performing the steps (a) and/or (c), the value of the temperature and/or the pressure, may be sensed by using the temperature sensor 75 and/or the pressure sensor 85.

In one embodiment of the method 100, prior to step (a), a level of load 99 may be determined during operation of the combustion system 1. In this embodiment, the steps (a) to (d) are performed if the level of load 99 so determined equals or exceeds a predetermined level 61 of load 99 at which it is desired to carry out steps (a) to (d), as shown in FIG. 9 for load levels within the load range 61. Thus at initial start-up phases the pilot-air may not be desired to be provided to the burner 30.

As shown in FIG. 9, and explained hereinabove, for load levels corresponding to the points 62 and 63 and to the points 64 and 65, in another embodiment of the method 100, the method 100 includes a step (e) of performing 150 one or more iterations of step (a) to step (d). As a result of the iteration, the method 100 includes at least the first set of steps (a) to (d) (i.e. the steps (a) to (d) performed corresponding to the points 62 and 63) and the second set of steps (a) to (d) (i.e. the steps (a) to (d) performed corresponding to the points 64 and 65, i.e. the first iteration). The first set and the second set are performed at different levels of loads 99.

Again as shown in FIG. 9, and explained hereinabove, for load level corresponding to the points 66 and 68, in another embodiment of the method 100, the method 100 includes a step (e) of performing 155 one or more iterations of step (a) to step (d). As a result of the iteration, the method 100 includes at least the third set of steps (a) to (d) (i.e. the steps (a) to (d) performed corresponding to the points 66 and 67) and the fourth set of steps (a) to (d) (i.e. the steps (a) to (d) performed also corresponding to the points 66 and 67, i.e. the first iteration). The third set and the fourth set are performed at same levels of loads 99.

In yet another embodiment of the method 100, the method 100 includes a step (f) of performing 160 one or more iterations of step (a) to step (e), i.e. the steps represented by reference numerals 110, 120, 130, 140 and 150 or the steps represented by reference numerals 110, 120, 130, 140 and 155. As a result of the iterations of the step (a) to the step (e), the method 100 includes at least a first set of steps (a) to (e) and a second set of steps (a) to (e). The first set of steps (a) to (e) and the second set of steps (a) to (e) are performed at different levels of loads 99 during operation of the combustion system 1. This embodiment may be understood similar to the aforementioned embodiment having the first set of steps (a) to (d) and the second set of steps (a) to (d).

It may be noted that in the present technique, the ratio of the pilot-fuel to the pilot-air may be altered, and in an embodiment of the method 100 is altered, from said ratio to the first ratio in step (b) and/or from the first ratio to the second ratio in step (d) by changing or altering or starting or stopping a rate of the pilot-air provided to the burner 30 while maintaining a rate of the pilot-fuel provided to the burner 30 at a constant rate. Thus by the method 100 and/or the system 1 of the present technique, the operating point may be navigated in such a way that the undesired regions A and B are avoided in the operation of the combustion system 1 or the gas turbine engine 10 that has the combustion system 1 included in it, by altering the pilot-fuel/pilot-air ratio at a given load level while keeping the pilot-fuel/total fuel ratio or the pilot-fuel/main-fuel ratio constant for that load level.

While the present technique has been described in detail with reference to certain embodiments, it should be appreciated that the present technique is not limited to those precise embodiments. It may be noted that, the use of the terms 'first', 'second', 'third', 'fourth', etc. does not denote any order of importance, but rather the terms 'first', 'second', 'third', 'fourth', etc. are used to distinguish one element from another. Rather, in view of the present disclosure which describes exemplary modes for practicing the invention, many modifications and variations would present themselves, to those skilled in the art without departing from the scope of this invention. The scope of the invention is, therefore, indicated by the following claims rather than by the foregoing description. All changes, modifications, and variations coming within the meaning and range of equivalency of the claims are to be considered within their scope.

The invention claimed is:

1. A method of controlling a pilot-fuel/pilot-air ratio provided to a burner of a combustion system of a gas turbine for altering an operating point of the combustion system, the combustion system comprises the burner and having a combustor volume including a radial swirler, a burner surface of the burner being contiguous with and facing the combustion volume, the combustion volume being formed by a pre-chamber and a combustion chamber, the burner includes a main-fuel supply line for introducing main-fuel into the radial swirler, wherein the radial swirler introduces the main-fuel and main-air into the ore-chamber, a pilot-fuel and a pilot-air provided to the pre-chamber via either a plurality of pilot-fuel holes and a plurality of pilot-air holes or a mix of the pilot-fuel and the pilot-air through an outlet present on the burner surface and in the ratio of pilot-fuel/pilot-air via a pilot-fuel supply line and a pilot-air supply line, respectively, the method comprising:

(a) determining if a value of a first parameter, which tends to move an operating point of the combustion system toward a first undesired region of operation, equals or exceeds a predetermined maximum limit of the first parameter, wherein the value of the first parameter is determined while the pilot-fuel and the pilot-air provided to the burner are in said ratio;

(b) changing said ratio to a first ratio of pilot-fuel/pilot-air provided to the burner such as to reduce the value of the first parameter to below the predetermined maximum limit of the first parameter, wherein said ratio is changed to the first ratio if the value of the first parameter, so determined, equals or exceeds the predetermined maximum limit of the first parameter;

(c) determining if a value of a second parameter, which tends to move the operating point of the combustion system toward a second undesired region of operation, equals or exceeds a predetermined maximum limit of the second parameter, wherein the value of the second parameter is determined while the pilot-fuel and the pilot-air provided to the burner are in the first ratio; and (d) changing the first ratio to a second ratio of the pilot-fuel/pilot-air such as to reduce the value of the second parameter to below the predetermined maximum limit of the second parameter, wherein the first ratio is changed to the second ratio if the value of the second parameter, so determined, equals or exceeds the predetermined maximum limit of the second parameter, wherein in changing said ratio to the first ratio in the step (b) and/or in changing the first ratio to the second ratio in the step d) the changing is performed by altering a rate of the pilot-air provided to the burner and by maintaining a rate of the pilot-fuel provided to the burner.

2. The method according to claim 1, wherein the first parameter is a temperature of a part of the combustion system and the second parameter is a pressure at a location of the combustion volume of the combustion system.

3. The method according to claim 2, wherein the step of (a) determining if the value of the first parameter equals or exceeds the predetermined maximum limit of the first parameter comprises a step of sensing the temperature of the part of the combustion system; and wherein the step of (c) determining if the value of the second parameter equals or exceeds the predetermined maximum limit of the second parameter comprises a step of sensing the pressure information indicative of the pressure at the location of the combustion volume.

4. The method according to claim 1, wherein the first parameter is a pressure at a location of the combustion volume and the second parameter is a temperature of a part of the combustion system.

5. The method according to claim 4, wherein the step of (a) determining if the value of the first parameter equals or exceeds the predetermined maximum limit of the first parameter comprises a step of sensing the pressure information indicative of the pressure at the location of the combustion volume; and wherein the step of (c) determining if the value of the second parameter equals or exceeds the predetermined maximum limit of the second parameter comprises a step of sensing the temperature of the part of the combustion system.

6. The method according to claim 1, further comprising: prior to step (a), a step of determining a level of load during operation of the combustion system to supply a load, and wherein the steps (a) to (d) are performed if the level of the load, so determined, equals or exceeds a predetermined level of the load at which it is desired to carry out steps (a) to (d).

7. The method according to claim 1, wherein the combustion system supplies a load, and wherein the method further comprises: (e) performing one or more iterations of step (a) to step (d), and wherein the one or more iterations comprises at least a first set of steps (a) to (d) and a second set of steps (a) to (d), and wherein the first set and the second set are performed at different levels of the load during operation of the combustion system.

8. The method according to claim 1, wherein the combustion system supplies a load, and wherein the method further comprising: (e) performing one or more iterations of step (a) to step (d), and wherein the one or more iterations comprises at least a third set of steps (a) to (d) and a fourth set of steps (a) to (d) successively performed after the fourth set, and wherein the third set and the fourth set are performed at same level of the load during operation of the combustion system.

9. The method according to claim 7, wherein the combustion system supplies a load, and wherein the method further comprises: (f) performing one or more iterations of step (a) to step (e), and wherein the one or more iterations comprises at least a first set of steps (a) to (e) and a second set of steps (a) to (e), and wherein the first set of steps (a) to (e) and the second set of steps (a) to (e) are performed at different levels of the load during operation of the combustion system.

10. A non-transitory computer-readable storage media comprising: instructions stored thereon and executable by one or more processors of a computer system, wherein execution of the instructions causes the computer system to perform the method according to claim 1.

11. A computer program stored on a non-transitory computer-readable medium, wherein the computer program, when executed by one or more processors of a computer system, perform the method according to claim 1.

* * * * *